US012709312B2

(12) United States Patent
Bleth et al.

(10) Patent No.: US 12,709,312 B2
(45) Date of Patent: Aug. 18, 2026

(54) ATTACHMENT PART FOR A RAIL VEHICLE

(71) Applicant: Siemens Mobility GmbH, Munich (DE)

(72) Inventors: Sebastian Bleth, Munich (DE); Jörg Melde, Olching (DE); Jörg Pforr, Moosach (DE)

(73) Assignee: Siemens Mobility GmbH, Munich (DE)

( * ) Notice: Subject to any disclaimer, the term of this patent is extended or adjusted under 35 U.S.C. 154(b) by 485 days.

(21) Appl. No.: 18/263,746

(22) PCT Filed: Dec. 6, 2021

(86) PCT No.: PCT/EP2021/084370
§ 371 (c)(1),
(2) Date: Aug. 1, 2023

(87) PCT Pub. No.: WO2022/161672
PCT Pub. Date: Aug. 4, 2022

(65) Prior Publication Data

US 2024/0116547 A1 Apr. 11, 2024

(30) Foreign Application Priority Data

Feb. 1, 2021 (DE) ..... 10 2021 200 849.6

(51) Int. Cl.
*B61D 23/00* (2006.01)

(52) U.S. Cl.
CPC ..... *B61D 23/00* (2013.01)

(58) Field of Classification Search
CPC ..... B61D 23/00; B60R 11/06; B60R 3/00
See application file for complete search history.

(56) References Cited

U.S. PATENT DOCUMENTS

| | | | | |
|---|---|---|---|---|
| 1,166,859 | A * | 1/1916 | Schroeder | B61D 23/00 182/93 |
| 8,678,695 | B2 * | 3/2014 | Baldus | F16B 9/056 280/756 |
| 9,403,541 | B2 * | 8/2016 | Henrici | B61D 23/00 |
| 10,737,625 | B2 * | 8/2020 | Michie | B60R 3/002 |
| 11,267,491 | B2 | 3/2022 | Evans et al. | |
| 2011/0265685 | A1 | 11/2011 | Swygert | |
| 2012/0013137 | A1 * | 1/2012 | Rinklin | B60R 19/50 293/155 |
| 2018/0327002 | A1 * | 11/2018 | Nasrabad | B61D 23/00 |
| 2020/0055527 | A1 * | 2/2020 | Evans | B61L 15/0027 |

(Continued)

FOREIGN PATENT DOCUMENTS

| | | |
|---|---|---|
| CN | 203020205 U | 6/2013 |
| CN | 203611998 U | 5/2014 |

(Continued)

*Primary Examiner* — Jason C Smith
(74) *Attorney, Agent, or Firm* — Laurence A. Greenberg; Werner H. Stemer; Ralph E. Locher

(57) ABSTRACT

An attachment part for a rail vehicle includes an interface and/or a mounting element for an accessory component for a switching operation. The attachment part can be detachably fastened to a rail vehicle structure of the rail vehicle in such a way that occurring forces can be transmitted to the rail vehicle structure. A rail vehicle including the attachment part is also provided.

22 Claims, 2 Drawing Sheets

(56) References Cited

U.S. PATENT DOCUMENTS

| | | | | |
|---|---|---|---|---|
| 2022/0402529 | A1* | 12/2022 | Li | B61D 33/0057 |
| 2024/0116547 | A1* | 4/2024 | Bleth | B60R 11/06 |

FOREIGN PATENT DOCUMENTS

| | | | | | |
|---|---|---|---|---|---|
| CN | 203651627 | U | * | 6/2014 | E05F 15/632 |
| CN | 204296736 | U | | 4/2015 | |
| CN | 206826657 | U | | 1/2018 | |
| CN | 207328450 | U | | 5/2018 | |
| CN | 109353361 | A | | 2/2019 | |
| CN | 110023147 | A | * | 7/2019 | B60R 19/34 |
| DE | 2931909 | | * | 8/1979 | B61D 23/02 |
| DE | 3137544 | A1 | * | 9/1981 | B61C 17/12 |
| DE | 102014212988 | A1 | | 1/2016 | |
| DE | 202019005439 | U1 | * | 9/2020 | B60R 11/06 |
| GB | 17054 | A | | 10/1910 | |
| JP | 2015128951 | A | * | 7/2015 | |
| WO | 2018034717 | A1 | | 2/2018 | |

* cited by examiner

ATTACHMENT PART FOR A RAIL VEHICLE

FIELD AND BACKGROUND OF THE INVENTION

The invention relates to an attachment part for a rail vehicle, in particular for a rail vehicle having an end cab, wherein the attachment part is conceived in particular for attachment in the front end region of a rail vehicle. The invention moreover comprises a rail vehicle having such an attachment part. The invention comprises in particular an attachment part with multiple functions.

The available space at the corners of the front end region (or "the front end regions", depending on the use) of a rail vehicle with an end cab is restricted by various attachments, e.g. crash elements or activators for couplings, or by the contour of the front nose, such that a usual arrangement in rail vehicles with a central cab of steps and handlebars for switching purposes according to a standard (e.g. EN16116-1 or -2) and resultant spaces to be kept free for handlebars and switchman steps cannot be implemented, or implemented only with difficulty, due to a lack of space.

Moreover, space is often required for a specific accessory during switching, e.g. for stop blocks, which should be readily available for switching purposes.

Up to now, the stop blocks have been in most instances stored together with other accessories in the interior of the rail vehicle, for example in the engine room. This is disadvantageous because said accessory is not immediately to hand (when stored in the interior). For space reasons, external containers are not provided in rail vehicles with an end cab. In some instances, there are external toolboxes in the underfloor region in other rail vehicles, but something like this is not yet known in the front end region. The tool, e.g. stop block, is thus not necessarily available where it is needed.

SUMMARY OF THE INVENTION

It is an object of the present invention to specify an attachment part for a rail vehicle, by way of which the disadvantages described above are avoided and a receptacle for an accessory for switching purposes is in particular guaranteed.

This object is achieved by an attachment part and by a rail vehicle as described below.

It is to be noted at the outset that positional references such as "top" and "bottom" as well as "rear" and "front" in terms of the attachment part must always be understood as being relative to the position of the attachment part on the rail vehicle according to the intended use, i.e. as if the attachment part were to be attached to the rail vehicle according to the intended use. "Top" means toward the roof of the rail vehicle, "bottom" means the opposite side, "rear" means toward the center of the rail vehicle, and "front" means toward the nearest buffer plate. Since the attachment to the rail vehicle in practice is unequivocal due to the very restricted possibilities and the predetermination of the position, any other positioning of the attachment part is fundamentally impossible, or would be unequivocally identified as incorrect (and thus as not according to the intended use).

An attachment part according to the invention for a rail vehicle comprises an interface and/or a mounting element for an accessory component for the switching operation, e.g. a tool, a handle, a step, a signal board, or a platform. It is important that the attachment part is able to be releasably fitted to a rail vehicle structure of the rail vehicle (in particular to a standard interface) in a way that forces which arise can be transmitted to the rail vehicle structure.

It is pointed out here that the term "accessory component" can be understood in a very wide sense. The term comprises not only tools but also warning elements, steps, platforms or handles which are advantageous for a switching operation or may even be necessary therefor. These accessory parts do not necessarily have to be components of the attachment part. However, it is essential that the attachment part is conceived so that the accessory components can be mounted (optionally in a retrievable manner). To this end, the attachment part comprises said interface, or said mounting element.

It is essential for the invention that the attachment part is releasably fastened (as it otherwise would not be an attachment part, for example) and that it is able to be fitted in a way that forces which arise can be transmitted to the rail vehicle structure so that the accessory parts, on which not insignificant forces act during the operation, can also be securely attached and used. In this way, the attachment part according to the invention in comparison to the dispersed arrangement to date (separate fitting) can unify various functions so as to take into account the restricted available space on the lateral front end region.

A rail vehicle according to the invention, in particular a locomotive for switching purposes, comprises an attachment part according to the invention which is releasably fastened to a rail vehicle structure (in particular to a standard interface) of the rail vehicle in a way that forces which arise are transmitted to the rail vehicle structure.

Further particularly advantageous design embodiments and refinements of the invention are derived from the dependent claims and from the description hereunder, wherein the claims of one category of claims may also be refined in a manner analogous to the claims and descriptive parts of another category of claims, and individual features of different exemplary embodiments or variants can in particular also be combined so as to form new exemplary embodiments of variants, respectively.

One preferred embodiment of the attachment part comprises an interface which is conceived for fitting a step, in particular a switching step, preferably in the lower and/or the upper part of the attachment part.

The term "step" herein is used so as to represent "stair", "rung" or "footplate", whereby footplates which are intended for prolonged standing are preferable. A "platform" (for example a switchman's platform) comprises a step and a railing or a handlebar.

One preferred embodiment of the attachment part comprises an interface which is conceived for fitting a platform, preferably a switchman's platform, in particular according to the standard EN16116-1, whereby the interface in this respect is preferably disposed in the lower region of the attachment part. Alternatively or additionally, such a platform is preferably a maintenance platform, whereby the interface in this respect is preferably disposed in the upper region of the attachment part.

One preferred embodiment of the attachment part comprises a mounting element which is conceived for storing tools (whereby a warning element here is also understood to be a tool), preferably for mounting a stop block or a signal, e.g. a tail signal. The mounting element can in particular be a pocket or flap into which a tool can be inserted. Said mounting element can also be a hook, whereby a pocket is preferable because a tool may swing back and forth on a hook. Such mounting elements which serve for mounting tools are known per se in principle. In the application according to the invention it is preferable for a mounting element to additionally have a fixing element, for example an eyebolt or a lockable flap, which serves for fixing a tool in the mounting element so that the latter cannot fall out when travelling over uneven track.

One preferred embodiment of the attachment part comprises an interface which is conceived for fitting a handle and/or a bar, preferably a handgrip and/or a handlebar and/or a footstep, in particular a handlebar for a switchman's platform. This interface may also be identical to one of the interfaces mentioned above. It is very advantageous for an interface to be designed such that different accessory components can be attached thereto.

One preferred embodiment of the attachment part comprises a fastening region which is designed such that said fastening region is able to be fitted to a standard interface of a rail vehicle, in particular of a rail vehicle with an end cab, preferably to a lateral standard interface. It is to be emphasized that the standard interface is not an interface of the attachment part but is part of the rail vehicle. The standard interfaces of a rail vehicle are known and are, for example, an arrangement of bores which are provided with a thread. In this instance, the fastening region preferably comprises an identical arrangement of bores so that the fastening region can be screwed to the respective standard interface.

One preferred embodiment of the attachment part, at least in the region of its fastening according to the intended use to the rail vehicle (in the fastening region) is shaped as a plate. This has the advantage that the attachment part bears flat on the rail vehicle, in particular when fitted laterally. Moreover, the attachment part is preferably shaped such that the contour of said attachment part when fitted according to the intended use to a rail vehicle does not protrude by more than 200 mm beyond the external lateral wall of the rail vehicle. This is advantageous in terms of aerodynamics, acoustics and operational safety because each element that protrudes beyond the contour of a rail vehicle represents a potential risk. Moreover, this serves for clearing specified loading gauges.

One preferred embodiment of the attachment part at the rear has a fastening region for fastening according to the intended use to the rail vehicle, and at the front at least one interface for fastening a step or a platform. The attachment part therebetween preferably has a mounting element which is conceived for storing tools.

One preferred embodiment of the rail vehicle comprises an end cab, wherein the attachment part is fitted in the region next to and/or in front of the end cab, and preferably is releasably fastened in the lateral region of the rail vehicle. The buffers of the rail vehicle here are preferably attached such that a switchman's platform according to an applicable standard, e.g. standard EN16116-1, can be fitted between the end cab and the buffer plate. One preferred end-cab locomotive for the switching operation comprises buffer systems, an end cab and a switchman's step in front of the end cab on the side of a first buffer system. The switchman's step here is disposed such that the buffer plane lies in front of the switchman's step when the buffer is completely elastically compressed. The space above the switchman's step, thus the space which is defined by the vertical projection of the switchman's step, thus lies outside the free space of the first buffer system. The attachment part is preferably designed and positioned such that this switchman's step can be fitted to the attachment part and be held on the end-cab locomotive by said attachment part.

According to one preferred embodiment of the rail vehicle, the attachment part is fitted to a standard interface of the rail vehicle. This is preferably a standard interface in the end region of the rail vehicle, in particular in the region of an end cab. A lateral standard interface of the rail vehicle is particularly preferable here because a comparatively high amount of force is transmitted to the rail vehicle structure at that location.

According to one preferred embodiment of the rail vehicle, the attachment part is screwed to the rail vehicle. As has already been indicated above, said attachment part preferably does not protrude by more than 200 mm beyond the lateral contour of the rail vehicle, in particular so that the required loading gauge is cleared, or any risk of injury is minimized.

According to one preferred embodiment of the rail vehicle, a platform, in particular a switchman's platform, a step, a railing and/or a handlebar are/is fitted, preferably releasably, in particular by means of a threaded connection, to the attachment part.

One advantage of the invention lies in that it is guaranteed that accessories for a switching operation, e.g. a lower step, the storage of accessories, and a gripping possibility can be made available to a switchman in the front end region in the tight conditions (restricted available space) in the rail vehicles with an end cab, and modifications can easily be carried out owing to the releasable connection to a standard interface. In this way, a standard locomotive can be modified from being a road locomotive (not intended for switching purposes) in such a manner that the latter meets the additional requirements set for a switching operation. This is made possible in particular by the releasable fastening to a standard interface.

The invention will be explained in more detail yet again hereunder with reference to the appended figures and by means of exemplary embodiments. Identical components are provided with the same reference signs in the various figures. The figures are typically not true to scale.

DETAILED DESCRIPTION OF THE INVENTION

Figure 1:
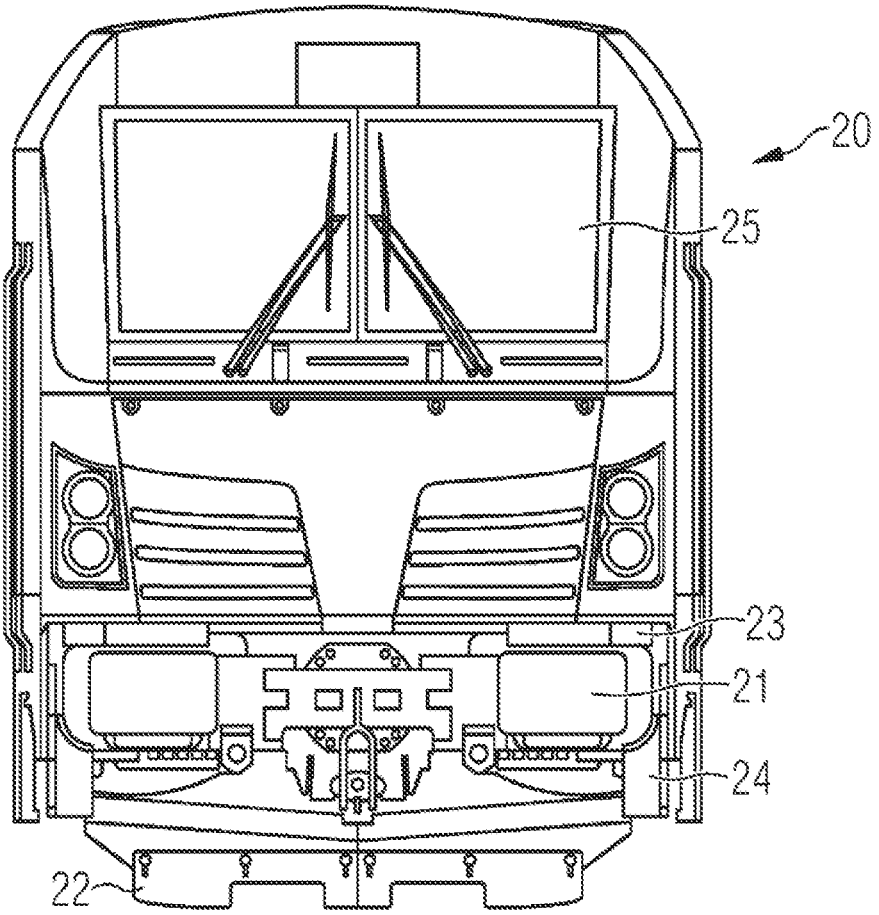
FIG 1 Prior Art
FIG. 1 shows a rail vehicle according to the prior art.
Figure 1:
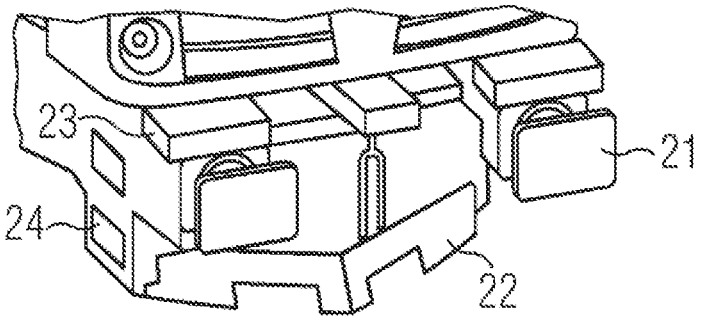
FIG 1 Prior Art

FIG. 1 shows a rail vehicle 20 with an end cab 25 according to the prior art, viewed from the front, and the buffer region thereof additionally once again in a perspective view for improved clarity. This is a typical embodiment of the front end region of a rail vehicle 20 with an end cab 25. The buffers 21 and the front skirt 22 can be clearly seen. Steps 24 are screwed to a lateral standard interface 23 on the side in the region of the end cab in the lower region.

Figure 2:
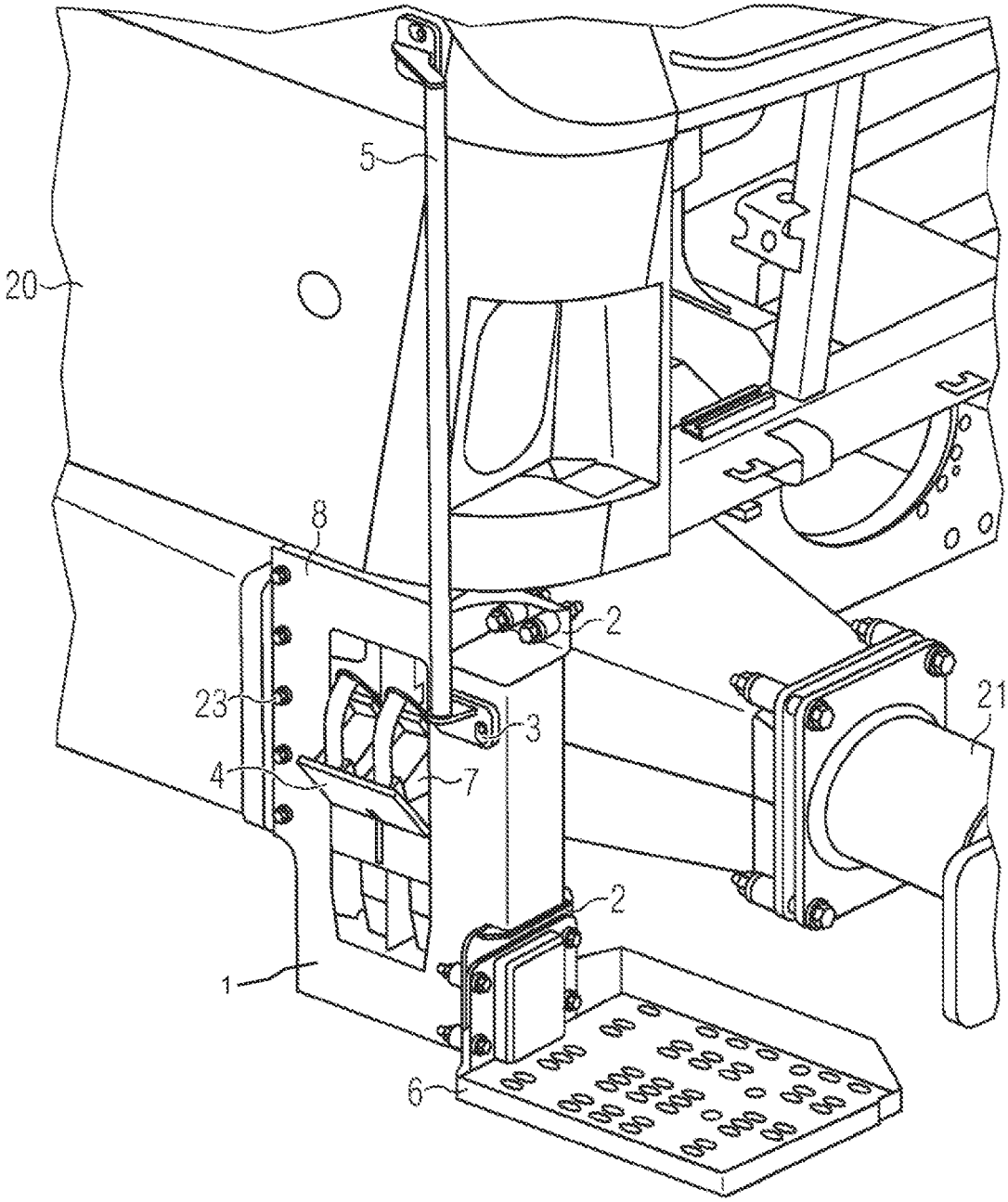
FIG. 2 shows a rail vehicle with a preferred attachment part.

FIG. 2 shows a rail vehicle 20 with a preferred attachment part 1 which is fitted to a lateral standard interface 23 in the region of the end cab 25 (cf. FIG. 1, for example; this is the standard interface 23 to which the steps 24 are fitted in FIG. 1).

The attachment part 1 at the rear comprises a fastening region 8 for fastening according to the intended use to a lateral standard interface 23 of the rail vehicle 20, and at the front comprises three interfaces 2, 3 for fastening a switchman's platform 6 at the bottom, a maintenance platform (not shown) at the top, and a handgrip 5 likewise at the top. The attachment part between the interfaces 2, 3 and the fastening region 8 has two mounting elements 4 which serve for storing stop blocks 7.

The attachment part 1 by way of the standard interface 23 is releasably fastened to a rail vehicle structure of the rail vehicle 20 by means of screws such that forces which arise, for example as a result of the weight of the stop blocks or the weight of a person standing on the switchman's platform, can be transmitted to the rail vehicle structure.

The attachment part 1 here in the region of its fastening according to the intended use to the rear vehicle 20 is shaped as a plate and in the region of the mounting elements 4 has a concavity so that the stop blocks 7 to not protrude by more than 200 mm beyond an external lateral wall of the rail vehicle 20. The front part is somewhat thickened and has approximately the cross section of a square. This serves for improved stability. Despite being thickened, this region does not protrude laterally beyond the lateral wall of the rail vehicle 20 but into the space at the buffers 21.

It is finally pointed out yet again that the embodiments described in detail above are merely exemplary embodiments which can be modified in the most varied way by a person skilled in the art, without departing from the scope of the invention. Furthermore, the use of the indefinite article "a" does not preclude that the respective features may also be present in multiples. Likewise, terms such as "unit" to not preclude that the respective components are composed of a plurality of interacting sub-components which may optionally also be distributed in space.

The invention claimed is:

1. An attachment part for a rail vehicle, the attachment part comprising:

a mounting element configured for storing tools in the form of stop blocks in a concavity in an external lateral wall at a front end region of the rail vehicle;

an interface configured for attaching a step or a platform;

a fastening region configured to permit said fastening region to be fitted to a standard interface of the rail vehicle; and the attachment part configured to be releasably fitted to a rail vehicle structure of the rail vehicle for permitting occurring forces to be transmitted to the rail vehicle structure.

2. The attachment part according to claim 1, which further comprises a lower part and an upper part of the attachment part, said interface configured for fitting the step as a switching step in at least one of said lower part or said upper part of the attachment part.

3. The attachment part according to claim 2, wherein said interface is configured for attaching the platform as a switching platform or a maintenance platform in at least one of said lower part or said upper part of the attachment part.

4. The attachment part according to claim 1, wherein said mounting element is also configured to hold a signal as the tools.

5. The attachment part according to claim 1, which further comprises a lower part and an upper part of the attachment part, said platform being a switchman's platform or a maintenance platform disposed in at least one of said lower or said upper part.

6. The attachment part according to claim 1, wherein said interface is configured for fitting at least one of a handle or a bar.

7. The attachment part according to claim 1, wherein said interface is configured for fitting at least one of a hand grip or a handlebar or a footstep or a handlebar for a switchman's platform.

8. The attachment part according to claim 1, wherein said fastening region is configured to be fitted to a lateral standard interface of a rail vehicle, the lateral standard interface being an arrangement of holes provided with a thread, and said fastening region including an identical arrangement of holes permitting said fastening region to be screwed to the interface.

9. The attachment part according to claim 8, wherein said fastening region is configured to be fitted to a lateral standard interface of a rail vehicle with an end cab.

10. The attachment part according to claim 1, wherein the attachment part has a region intended to be fastened to the rail vehicle, and the attachment part is shaped as a plate at least in said region.

11. The attachment part according to claim 10, wherein the attachment part is shaped with a contour when fitted as intended to the rail vehicle, and said contour does not protrude by more than 200 mm beyond an external lateral wall of the rail vehicle.

12. The attachment part according to claim 1, which further comprises a rear and a front of the attachment part, said rear having said fastening region for fastening as intended to the rail vehicle, and said front has at least one said interface for fastening a step or a platform.

13. The attachment part according to claim 12, wherein said mounting element is disposed between said rear and said front and is configured for storing the tools.

14. A rail vehicle or locomotive for switching, the rail vehicle comprising:

a rail vehicle structure of the rail vehicle; and an attachment part according to claim 1;

said attachment part being releasably fastened to said rail vehicle structure for transmitting occurring forces to the rail vehicle structure.

15. The rail vehicle according to claim 14, which further comprises an end cab, said attachment part being fitted in a region at least one of next to or in front of said end cab.

16. The rail vehicle according to claim 15, wherein said attachment part is releasably fastened in a lateral region of the rail vehicle.

17. The rail vehicle according to claim 14, which further comprises a standard interface of the rail vehicle, said attachment part being fitted to said standard interface.

18. The rail vehicle according to claim 17, wherein:

said standard interface is disposed in an end region of the rail vehicle, or said standard interface is disposed in a region of an end cab, or said standard interface is a lateral standard interface.

19. The rail vehicle according to claim 14, wherein said attachment part is screwed to the rail vehicle.

20. The rail vehicle according to claim 19, wherein said attachment part does not protrude by more than 200 mm beyond a lateral contour of the rail vehicle.

21. The rail vehicle according to claim 14, wherein said attachment part is connected to at least one of a platform, a switchman's platform, a step, a railing or a handlebar.

22. The rail vehicle according to claim 1, wherein said concavity of said mounting element is a pocket having a flap for securing the stop blocks in said pocket.

* * * * *